US005155709A

United States Patent [19]

Flanagan et al.

[11] Patent Number: 5,155,709

[45] Date of Patent: Oct. 13, 1992

[54] ELECTRO-ACOUSTIC TRANSDUCERS

[75] Inventors: Peter F. Flanagan, Cranston; Roger Mark, Barington, both of R.I.

[73] Assignee: Raytheon Company, Lexington, Mass.

[21] Appl. No.: 727,760

[22] Filed: Jul. 10, 1991

[51] Int. Cl.[5] ..... H04R 17/00

[52] U.S. Cl. ..... 367/174; 367/158; 367/163; 367/167; 367/172; 310/334; 310/337; 29/25.35

[58] Field of Search ..... 367/157, 158, 163, 167, 367/168, 172, 174; 310/337, 334; 29/25.35

[56] References Cited

U.S. PATENT DOCUMENTS

| | | | |
|---|---|---|---|
| 4,731,764 | 3/1988 | Ponchaud | 367/158 |
| 4,737,939 | 4/1988 | Ricketts | 367/158 |
| 4,845,687 | 7/1989 | Bromfield | 367/158 |
| 4,899,543 | 2/1990 | Romanelli et al. | 60/527 |
| 4,970,706 | 11/1990 | Tocquet et al. | 367/158 |
| 5,016,228 | 5/1991 | Arnold et al. | 367/163 |

*Primary Examiner*—J. Woodrow Eldred

*Attorney, Agent, or Firm*—Judith A. Caplan; Richard M. Sharkansky

[57] ABSTRACT

A transducer for use in surface ship applications includes a prestress element for providing additional compressive force to an electromechanical driver disposed within the transducer. The transducer includes a shell having inner portions, an electromechanical driver having end portions coupled to inner portions of the shell, and a block prestress element disposed between one of the end portions of the driver and the inner portions of the shell. The block prestress element is fabricated from a shape memory alloy which can be deformed within a first temperature range and reverts back to its original shape when exposed to a temperature above the first temperature range. This characteristic provides for the generation of additional stresses which may be desired for providing protection to the electromechanical driver from unwanted tensile forces. This approach for providing additional compressive force to the driver allows the insertion of the stacked ceramic electromechanical driver within the shell with prestress levels generally not achievable without possible damage to the shell.

14 Claims, 2 Drawing Sheets

ELECTRO-ACOUSTIC TRANSDUCERS

BACKGROUND OF THE INVENTION

The invention relates generally to electro-acoustic transducers and more particularly to transducers having ceramic drivers.

As is known in the art, a transducer is a device that converts energy from one form to another. In underwater acoustic systems, transducers generally are used to provide an electrical output signal in response to an acoustic input which has propagated through a body of water, or an acoustic output into the body of water in response to an input electrical signal.

A transducer intended primarily for the generation of an acoustic output signal in response to an electrical signal is generally referred to as a projector. Conversely, a transducer designed for producing an electrical output in response to an acoustic input is called a hydrophone. Both hydrophone and projector transducers are widely employed in sonar systems used for submarine and surface ship applications.

Transducers generally include a mechanical member such as a piston, shell, or cylinder and a driver. In applications where the transducer is used as a projector, the driver is responsive to electrical energy and converts such energy into mechanical energy to drive the mechanically driven member. The driven member converts the mechanical energy into acoustic waves which propagate in the body of water. Most acoustic transducers have driver elements which use materials having either magnetostrictive or piezoelectric properties. Magnetostrictive materials change dimension in the presence of an applied magnetic field, whereas piezoelectric materials undergo mechanical deformation in the presence of an electrical field. A common piezoelectric driver is the ceramic stacked driver which is made up of individual ceramic elements which are stacked with alternating polarities. In this stacking arrangement, the ceramic stack is longitudinally polarized. Electrical drive is applied to the elements of the ceramic stack and in response, each element expands and contracts in the longitudinal direction. The individual element displacements accumulate to provide a net displacement of the stack.

A common configuration for acoustic transducers used in underwater environments is the longitudinally polarized cylindrical projector, known commonly as the Tonpilz projector. The Tonpilz projector makes use of a stack of cylindrical ceramic elements mounted between a weighted baseplate, called the tail mass, and a lighterweight movable solid metal piece with a flat circular, or piston-like, face called the head mass. A bias rod through the center of the ceramic stack connects the tail mass to the head mass. In one common configuration, the bias rod has a threaded portion at one end which mates with a complementary threaded hole of the head mass. The driver elements and tail mass are placed over the rod and secured together with a locking nut. A predetermined torque is applied to the nut for compressing, or prestressing, the ceramic elements so that they are protected from tensile forces which are generally detrimental to ceramic piezoelectrics. In some applications, the needed prestress may require a level of torque that may be difficult to administer and control.

Another projector which is commonly used when light weight, small size and/or high efficiency is needed, is the so-called flextensional transducer. One known flextensional transducer includes a rectangular ceramic driver mounted within and along the major axis of an elliptically shaped shell. Prestress is applied to the driver by compressing the shell along its minor axis, thereby extending the major axis dimension allowing a slightly oversized ceramic stack driver to be placed along the major axis. Releasing the compressive force applied to the elliptical shell places the driver in compression. With this configuration, the elliptical shell acts as a mechanical impedance transformer between the driving element and the medium, such as a body of water, in which the transducer is disposed. The dynamic excitation of the ceramic stack driver causes the stack to expand and contract. A small velocity imparted at the ends of the ceramic stack is converted to a much larger velocity at the major faces of the elliptical shell resulting in the generation of an acoustic pressure field within a medium in which the transducer is disposed. It is generally desired for good electro-acoustic efficiency that contact is made to the drive points of the shell only by the ceramic stack assembly.

One problem with applying compressive prestress to the ceramic stack drivers in a flextensional transducer relates to the earlier mentioned technique for inserting the ceramic stack within the shell. Compressing the minor axis in order to allow the major axis dimension to extend allows the slightly oversized ceramic stack driver to be placed along the major axis. However, the amount of compressive force is limited by the extent to which the shell can be compressed and is generally dependent on the geometry and material of the shell. The application of excessive force to the minor axis can cause the shell to yield, resulting in a ruptured shell.

SUMMARY OF THE INVENTION

In accordance with the present invention, a transducer includes a shell having inner portions and an electromechanical driver having end portions coupled to inner portions of the shell. The transducer further includes a member, disposed between one of the end portions of the driver and the inner portions of the shell, to provide a compressive force on the driver wherein the member comprises a material having a first shape at a first temperature range that can be deformed to a second shape upon subjecting the material to a second, different temperature range, and which reverts back to the first shape when the material is returned to the first temperature range. With such an arrangement, a transducer is provided with a member to provide the compressive force on a driver so the driver is protected from tensile forces which are generally detrimental to the elements of the driver. The member is provided from a material having a characteristic such that the material has a first shape that can be deformed to a second shape and, upon subjecting the material to a predetermined temperature, reverts back to the first shape allows additional compressive force to be applied to the ceramic stack to be provided after being inserted within the shell. This characteristic substantially reduces the amount of force required to be applied to the shell to provide sufficient clearance for inserting the stack driver into the shell.

In accordance with a further aspect of the invention, a transducer includes a head mass, a tail mass, and an electromechanical driver having end portions with the electromechanical driver being disposed between the head mass and the tail mass. The transducer further includes a member, disposed to provide a compressive force on the driver with the member comprised of a material having a characteristic that the material has a first shape at a first temperature range and that the member can be deformed to a second shape upon subjecting the material of the member to a second, different temperature range, and the member reverts back to the first shape when the material is returned to the first temperature range. The transducer further includes a rod disposed through the driver and the member and coupled to the head mass and the tail mass. With such an arrangement, the rod disposed through the driver and coupled to the head mass and the tail mass provides a compressive force to the electromechanical driver disposed therebetween. The member disposed between the head mass and the tail mass provides additional compressive force to the driver without the application of excessive torque to the bias rod.

BRIEF DESCRIPTION OF THE DRAWINGS

The foregoing features of this invention, as well as the invention itself, may be more fully understood by the following detailed description of the drawings, in which.

DESCRIPTION OF THE PREFERRED EMBODIMENT

Figure 1:
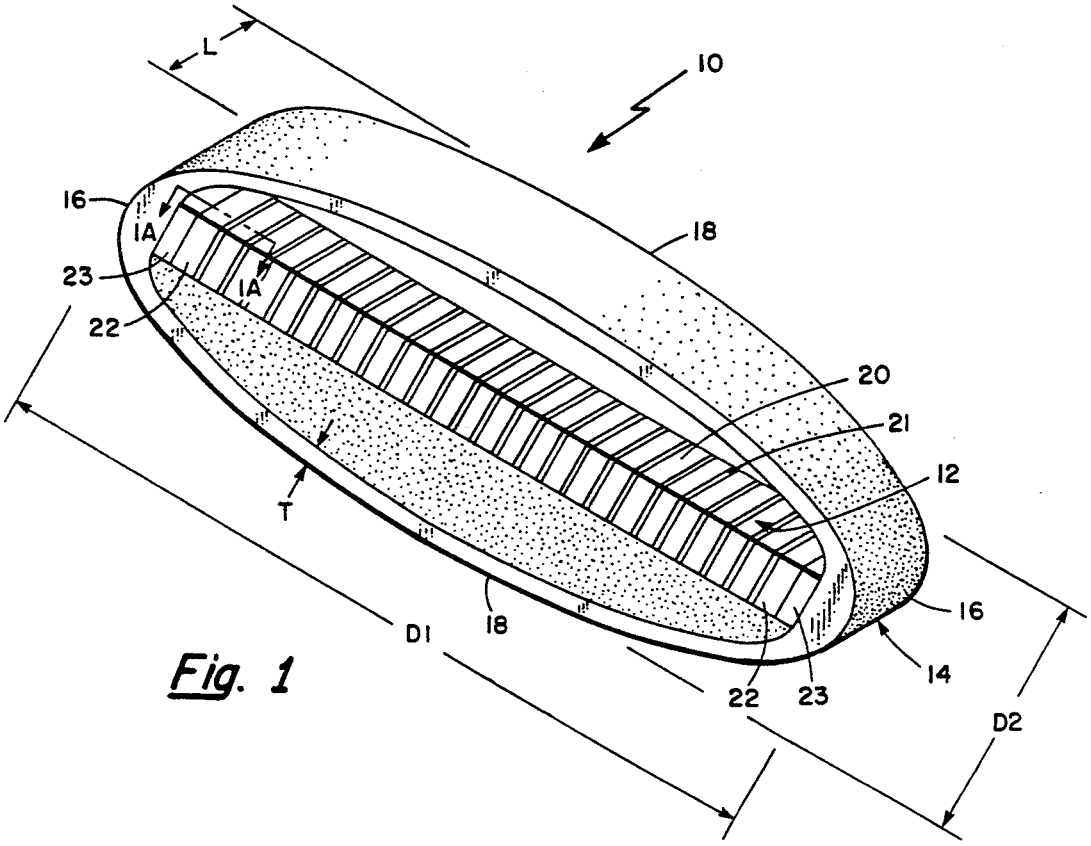
FIG. 1 is an isometric view of a flextensional transducer having block members disposed at each end of a ceramic stack driver.
Figure 1A:
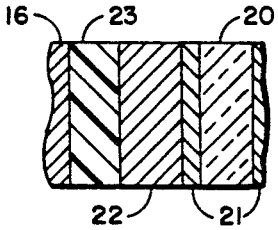
FIG. 1A is a cross-sectional view of a portion of FIG. 1 taken along lines 1A—1A.

Referring now to FIG. 1-1A, a flextensional transducer 10 is shown to include an electromechanical driver assembly 12 disposed within an oval or elliptical shell 14 having a predetermined midwall major diameter (D1), midwall minor diameter (D2), wall thickness (T), and an axial length (L) for providing a required acoustic performance characteristic. The shell 14 further has end portions 16 and flexing portions 18 disposed at the major and minor diameters, respectively.

The electromechanical driver assembly 12 is shown to include a stack of rectangular, here PZT (lead-zirconate, lead titanate), ceramic bars 20 having foil electrical conductors 21 disposed between individual ceramic segments and laminated together with epoxy glue, as is generally known in the art. The polarity of the ceramic bars 20 are alternated at every other electrode. Generally, a negative polarity is present at both ends of the driver stack assembly 12. Block prestress members 22 are disposed at each end of the electromechanical driver assembly 12 to provide compressional force on the driver, as will be described. In applications where the elliptical shell is fabricated with an electrically conductive material, it is generally required that isolation sections 23 be disposed between end portions 16 of the shell 14 and the electromechanical driver assembly 12 for providing electrical isolation therebetween. The isolation sections 23 may be disposed between the block prestress sections 22 and end portions 16 of the shell or alternatively between the block prestress sections 22 and the driver assembly 12.

As is known in the art, piezoelectric ceramic drivers are desired to be disposed within a transducer under a predetermined compression or "prestress" condition. Prestress compression on the ceramic stack is necessary for generally preventing damage to the ceramic stack due to tensile stresses induced by the applied electrical signal. Prestress is generally applied in a flextensional transducer by compressing the elliptical shell 14 along its minor axis at flexing portions 18, thereby extending the major axis for insertion of the electromechanical driver assembly 12. When the compressive force on the elliptical shell 14 is removed, the shell returns to its uncompressed shape, which causes end portions 16 of the shell to provide a compressive force on the drive assembly. That is, the electromechanical driver assembly 12 is said to be "preloaded" or prestressed between the end portions 16 of the shell.

The prestress member 22 is fabricated from a material having the characteristic of shape memory. Shape memory materials can be deformed, quite severely in some cases, and then the deformation completely removed by heating the material to a predetermined temperature, known as the "transformation temperature". This effect is caused by a change in the structure of the material. There are a limited number of alloys which undergo this special transformation that lead to the shape memory effect including AuCd, CuZn, InTi, FePt, and NiTi. The material used here is a Nickel-Titanium (NiTi) alloy, often called Nitinol, having the aforesaid shape memory characteristic. The NiTi alloy used here is manufactured by The Raychem Company, Menlo Park, Calif. Alternatively, nickel-titanium alloys having shape memory characteristics may also be obtained from the Furukawa Electric Company, Ltd., Tokyo, Japan. In the case of shape memory alloys, the metal changes from a complex lower temperature crystalline form which can absorb some reversible "plastic" deformation to a stronger cubic crystalline form in which the "plastic" deformation is completely reversed as the structure transforms to the higher temperature form.

In this embodiment, the prestress block 22 is fabricated such that at temperatures typical of the environment in which the transducer 10 is used, the NiTi alloy is in an austenitic state; that is, its rigid, non-deformable condition. The block is only able to be deformed into a martensitic malleable condition when its temperature is below the transformation temperature. For this reason, the transformation temperature is selected to be lower than the lowest temperature in which the block will be exposed to in operation.

In one particular application, a flextensional transducer is used at an ocean depth where the hydrostatic pressure exerts a compressive force on the elliptical shell such that the prestress force provided by the shell to the electromechanical driver is reduced. In order to provide a sufficient prestress for protecting the ceramic elements of the driver at the ocean depth at which the transducer is operating, a compressive prestress of 12,000 psi at sea level is required. For this particular application, a prestress NiTi block having a thickness of 0.260" in a state below the transformation temperature is required. The prestress block section 22 is cooled below the transformation temperature, here −40° F., and then placed between the electromagnetic driver assembly 12 and an end portion 16 of the elliptical shell 14. The length of the driver assembly 12 in combination with the thickness of the prestress block section and any isolator sections is desired to be slightly larger than the major diameter of the elliptical shell 14, such that a limited amount of compressive force applied to the minor axis of the shell may be required. This limited amount of compressive force is significantly less than the force required to cause the shell to yield and rupture. When the temperature of the block increases above the transformation temperature, its thickness increases to 0.273", a five percent increase in its overall thickness. The transducer assembly 10 is thereby provided with the desired amount of prestress without the need for applying excessive force to the shell.

As shown in FIG. 1, the transducer assembly 10 here uses a pair of prestress block sections 22 disposed at each end of the electromechanical driver assembly 12. However, depending on the particular application of the transducer and amount of prestress required, a single prestress block section or a plurality of prestress block sections may be disposed between the driver assembly 12 and shell 14. The prestress block sections may even be disposed between the individual ceramic elements 20 of the electromechanical driver assembly 12.

Figure 2:
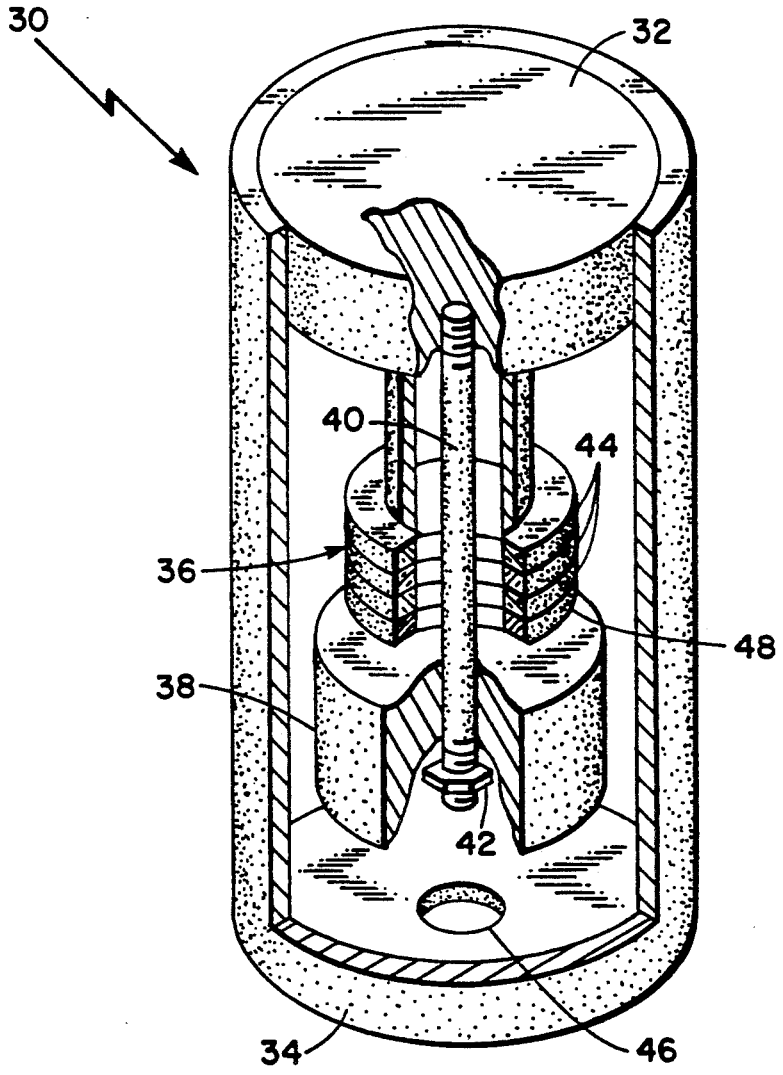
FIG. 2 is an isometric view of a longitudinally polarized cylindrical projector having a block element disposed upon a ceramic driver.

Referring now to FIG. 2, a longitudinally polarized cylindrical projector 30, known commonly as the Tonpilz projector, is shown to include a movable solid metal piece having a flat circular, or piston-like, face called the head mass 32 disposed here, within a cylindrical housing 34. The housing 34 is shown here to have an inner diameter substantially equal to the diameter of the head mass 32 and a length for accommodating the internal components of the cylindrical projector 30.

The cylindrical projector 30 further includes an electromechanical driver assembly 36, here piezoelectric ceramic, disposed between the head mass 32 and a stationary baseplate, called a tail mass 38. A bias rod 40, disposed through the electromechanical driver element 36, connects the head mass 32 to the tail mass 38 and compresses, or prestresses, the piezoelectric ceramic so that they are protected from tensile forces. The bias rod 40 is shown here, having a threaded end portion, extending through the tail mass 38 for fixing a locking nut 42 to the rod. The locking nut 42 is screwed to the bias rod with a predetermined torque.

The electromechanical driver assembly 36 is comprised of a stack of longitudinally polarized cylindrical ceramic elements 44. Electrical drive is applied to the elements of the ceramic stack and in response, each element expands and contracts in the longitudinal direction. The individual element displacements provide a net displacement of the stack. The housing 34 further includes a connector hole 46 for providing access for wiring generally required for supplying power to the electromechanical assembly 36.

A cylindrical prestress element 48 is shown here, disposed between the driver assembly 36 and the tail mass 38 for providing additional compressive force to the driver assembly 36. A single prestress element is shown here; however, a plurality of such prestress elements may be used at either end of the driver assembly or between individual ceramic elements. The prestress element 48 is fabricated from a shape memory metal, such as NiTi, and further has similar transformation temperature characteristics to the embodiment as was discussed in conjunction with the flextensional transducer 10.

One approach for the installation of the prestress element 48 would include securing the electromechanical assembly 36 and the prestress element 48 between the head mass 32 and the tail mass 38 by tightening the locking nut 42 disposed on the bias rod 40 while concurrently maintaining the prestress element 48 at a temperature below its transformation temperature. As the temperature of the prestress element 48 is raised above the transformation temperature, its dimension along the longitudinal axis is allowed to increase to its second state, placing the driver assembly 36 into further compression. Because the dimensions of the element 48 are known before it is cooled and compressed into its shorter dimension malleable state, the amount of torque applied to the locking nut 42 can be predetermined such that when the element is in its expanded dimension, rigid condition, the desired compressive force to the electromechanical assembly 36 is achieved.

In both of the configurations shown in FIGS. 1, 1A, and 2, the use of prestress sections 22, 48 generally facilitates the installation of the electromechanical driver within the transducer assemblies in a prestress condition. In the same way, the disassembly of the transducer may be accomplished by cooling the prestress section or element to below its transformation temperature, allowing the prestress section to return to its martensitic malleable state. This feature may be important in applications where the ceramic elements of the electromechanical driver are prone to fracturing during the disassembly of the transducer.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A transducer comprising:

a shell having inner portions;

an electromechanical driver having end portions coupled to inner portions of the shell; and a member, disposed between one of said end portions of the driver and said inner portion of the shell, to provide a compressive force on said driver, said member comprising a shape memory material having a first shape at a first temperature range, and deformable to a second shape, upon subjecting the material to a second, different temperature range, and when the material returns to the first temperature range, reverts back to said first shape.

2. The transducer as recited in claim 1 wherein said material has a transformation temperature less than 32° F.

3. The transducer as recited in claim 2, wherein material is a shape memory alloy.

4. The transducer as recited in claim 3 wherein said shape memory alloy is from the group consisting of AgCd, AuCd, CuAlNi, CuSn, CuZn, InTl, NiAl, NiTi, FePt, MnCu, and FeMnSi.

5. A transducer comprising:

a shell having inner portions;

a piezoelectric ceramic electromechanical driver having end portions coupled to inner portions of the shell; and a block, disposed between one of said end portions of the driver and said inner portion of the shell, wherein the block is fabricated from a NiTi alloy having a shape memory characteristic.

6. The transducer as recited in claim 5 wherein said NiTi alloy has a transformation temperature of −40° F.

7. The transducer as recited in claim 6 wherein said NiTi alloy has a composition of Ni between 36% and 38%.

8. A transducer comprising:

a head mass;

a tail mass;

an electromechanical driver having end portions;

a member, disposed between said head mass and said tail mass, to provide a compressive force on said driver, said member comprised of a shape memory material having a first shape at a first temperature range, and deformable to a second shape, upon subjecting said material to a second temperature range, and when the material returns to the first temperature range, reverts back to said first shape; and a rod disposed through said driver and said member and coupled to said head mass and said tail mass.

9. The transducer as recited in claim 8 wherein said member is fabricated from a shape memory alloy.

10. The transducer as recited in claim 9 wherein said shape memory alloy has a composition including nickel and titanium.

11. The transducer as recited in claim 10 wherein said NiTi has a transformation temperature of −40° F.

12. The transducer as recited in claim 11 wherein said electromechanical driver comprises a plurality of cylindrical piezoelectric ceramic driver elements in a stacked arrangement.

13. A transducer comprising:

an elliptical shell having inner portions and a major diameter;

a piezoelectric electromechanical driver disposed along said major diameter of the shell and having end portions coupled to inner portions of the shell; and a block element disposed between one of said end portions of the driver and said inner portion of said shell and fabricated from a shape memory alloy.

14. The transducer, as recited in claim 13, wherein said shape memory alloy is nickel-titanium having a transformation temperature of −40° F.

* * * * *